US006242897B1

(12) United States Patent
Savage et al.

(10) Patent No.: US 6,242,897 B1
(45) Date of Patent: Jun. 5, 2001

(54) CURRENT STACKED BANDGAP REFERENCE VOLTAGE SOURCE

(75) Inventors: Scott C. Savage; Ricky F. Bitting, both of Fort Collins, CO (US)

(73) Assignee: LSI Logic Corporation, Milpitas, CA (US)

( * ) Notice: Subject to any disclaimer, the term of this patent is extended or adjusted under 35 U.S.C. 154(b) by 0 days.

(21) Appl. No.: 09/497,652

(22) Filed: Feb. 3, 2000

(51) Int. Cl.[7] ..... G05F 3/16; G05F 3/20
(52) U.S. Cl. ..... 323/313; 323/316
(58) Field of Search ..... 323/313, 314, 323/315, 316

(56) References Cited

U.S. PATENT DOCUMENTS 4,636,710 * 1/1987 Stanojevic ..... 323/280
4,896,094 * 1/1990 Greaves et al. ..... 323/314
5,307,007 * 4/1994 Wu et al. ..... 323/313
5,325,045 * 6/1994 Sundby ..... 323/313
6,016,051 * 1/2000 Can ..... 323/315

OTHER PUBLICATIONS

"A Programmable CMOS Dual Channel Interface Processor for Telecommunications Applications" by Bhupendra K. Ahuja et al., *IEEE Solid–State Circuits*, vol. SC–19, No. 6, pp. 892–899, Dec. 1984.

* cited by examiner

*Primary Examiner*—Edward H. Tso
*Assistant Examiner*—Bao Q. Vu

(57) ABSTRACT

An on-chip voltage reference supply operates in the current domain rather than the voltage domain, implemented with a single diode drop to reduce power supply headroom requirements. A plurality of current generators generate currents representing a first design voltage. A gain circuit responds to the currents to supply a gain voltage representing the sum of the first design voltages. A summing circuit sums the gain voltage and a second design voltage to derive the predetermined reference voltage.

19 Claims, 2 Drawing Sheets

CURRENT STACKED BANDGAP REFERENCE VOLTAGE SOURCE

BACKGROUND OF THE INVENTION

This invention relates to reference voltage sources and particularly to on-chip current stacked band gap reference voltage sources.

On-chip voltage reference sources employ voltage stacked bipolar transistor array bandgap structures to derive reference voltages for use on the chip. Stacked bipolar arrays reduce sensitivity to operational amplifier offsets, resistor mismatches, and current mirror mismatches, without employing laser trimming or autozeroing clocks. One advantage of a stacked array is that a large ΔVbe voltage can be derived to enhance the tolerance of the circuit by minimizing errors due to offsets and mismatches due to reduced gain to the output.

Stacked reference voltage sources reduce the effect of error voltages, such as offset due to amplifier, resistor and current mirror mismatches, by increasing the contribution of the ΔVbe voltage. By employing an area-ratioed stack of matched bipolar transistors, a +TC reference voltage is produced which is N times the ΔVbe voltage, where N is the number of stacks in the array. The +TC voltage is proportional to K (NΔVbe+Vos) where Vos is the error voltage due to offset. Thus, the offset is effectively reduced by a factor of N. It will be appreciated that the error voltage is multiplied by the constant K, but the constant K may be reduced by increasing the number of levels in the stack of the array. See Ahuja et al., "A Programmable CMOS Dual Channel Interface Processor for Telecommunications Applications", *IEEE Journal on Solid-State Circuits*, Vol. SC-19, No. 6, pp. 892–899 (December 1984).

However, voltage stacked bipolar transistor arrays require significant supply headroom for operation. For example, three stacked Vbe diode drops of an array of three bipolar transistors requires approximately a headroom of 2.1 volts (assuming 0.7 volt diode drops). Moreover, the transistors exhibit a temperature coefficient of about −2 mV/° C., so when operating at extreme temperature conditions (such as −50° C.), the required supply headroom increases to approximately 2.55 volts for three diode drops. While reducing the stack size to two transistors reduces the required supply headroom to about 1.4 volts (1.7 volts at −50° C.), the reduction of the array size requires increasing constant K to achieve the desired reference voltage, and is not as effective in reducing sensitivity to offsets and mismatches. Further, in modern IC processes, where power supplies may he of the order of 1.8 volts ±10%, voltage stacked arrays are not realizable.

SUMMARY OF THE INVENTION

The present invention is directed to an on-chip voltage reference source operating in the current domain instead of voltage domain, thereby allowing implementation employing a single diode drop, thereby reducing required supply headroom.

In a preferred form of the invention a current stacked reference voltage source is provided to generate a predetermined reference voltage. The reference voltage source includes a plurality of current generators each generating a current representing a first design voltage; each current generator has no more than a single diode drop to generate the current. A gain circuit is responsive to the currents generated by the current generators to supply a gain voltage representing the sum of the first design voltages. A summing circuit sums the gain voltage and a second design voltage to derive the predetermined reference voltage.

Another form of the invention provides an integrated circuit chip current having a stacked reference voltage circuit. The reference voltage circuit includes a plurality of current generators, a summing node and an output circuit. Each current generator has first, second and third current sources having control nodes coupled together. A differential amplifier has a first input coupled to the first current source, a second input coupled to the third current source and an output coupled to the control nodes of the current sources. A first semiconductor device has a control node coupled to the second current source. A first impedance is coupled to the control node of the first semiconductor device in series with the third current source. A fourth current source supplies current to the summing node representative of current supplied by the third current source. The summing node sums current supplied by each of the fourth current sources of the current generators. The output circuit includes a fifth current source, and a second semiconductor device. A control node of the second semiconductor device is coupled to the summing node. A second impedance circuit is coupled to the control node of the semiconductor device in series with the fifth current source. An output is coupled to the controlled node of the second semiconductor device to provide the reference voltage.

In a preferred form of the invention, each current generator further includes a third semiconductor device coupled between a supply node and the first current source. The first and third current sources supply different current values and the first and third semiconductor devices have different active areas. The first impedance provides a voltage (ΔVbe) to the control node of the first semiconductor device based on a difference between the current values supplied by the first and third current sources and the active areas of the first and third semiconductor devices.

In another preferred form of the invention, each of the first impedances provides a first impedance value (R1) and the second impedance provides a second impedance value (R1+R2) greater than the first impedance value. The second semiconductor device operates with the second impedance to provide a gain constant to a voltage at the control node of the second semiconductor device of (1+R2/R1).

In another preferred form of the invention, the second impedance provides a voltage to the control node of the second semiconductor device having a value of N(1+R2/R1)ΔVbe, where N is the number of current generators.

In another preferred form of the invention, the second semiconductor device has a diode drop voltage (Vbe) between its control node and controlled node. Thus, the output supplies the reference voltage having a value of N(1+R2/R1)ΔVbe+Vbe.

In another form of the invention, a method of generating a reference voltage is provided by which a plurality of currents are generated, each representing a first design voltage. The currents are summed, and the reference voltage is derived based on the sum of the plurality of currents. In one form of the invention, the derivation of the reference voltage is performed by deriving a gain voltage based on the sum of the plurality of currents, and summing the gain voltage with a second design voltage.

DETAILED DESCRIPTION OF THE ILLUSTRATIVE EMBODIMENTS

Figure 1:
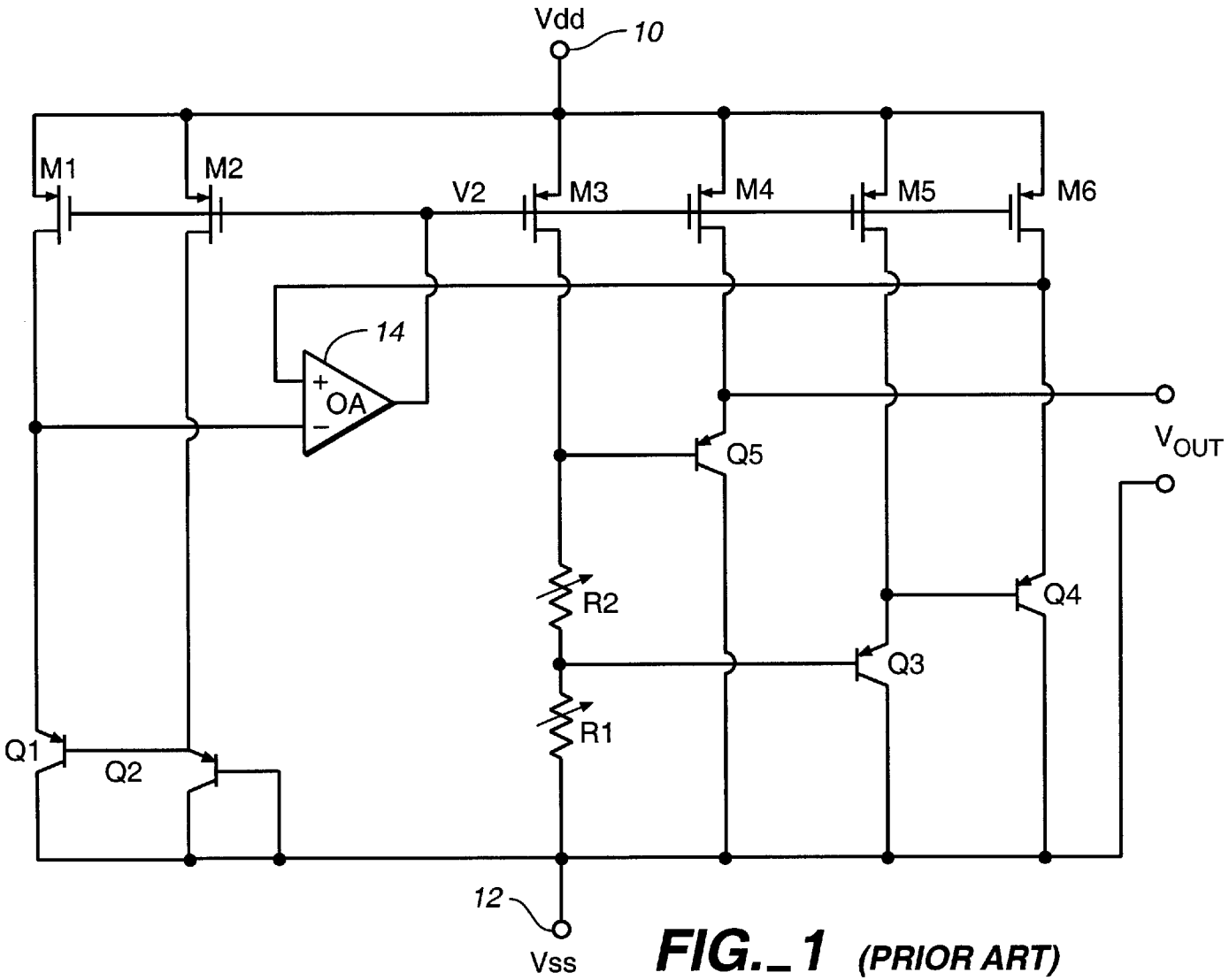
FIG. 1 (PRIOR ART)
FIG. 1 is a circuit diagram of a voltage stacked array bandgap reference voltage source in accordance with the prior art.

FIG. 1 illustrates a double voltage stack structure of a prior art transistor array bandgap structure. P-channel MOSFETs M1, M2, M3, M4, M5 and M6 have their sources connected through node 10 to positive voltage supply Vdd. The drains of MOSFETs M1 and M2 are connected to the emitters of PNP transistors Q1 and Q2, and the drains of MOSFETs M5 and M6 are connected to the emitters of PNP transistors Q3 and Q4. The gates of MOSFETs M1, M2, M3, M4, M5 and M6 are connected together. The collectors of transistors Q1, Q2, Q3 and Q4 are connected through node 12 to negative voltage supply Vss. (While supplies Vdd and Vss are described as positive and negative, the circuit of FIG. 1 only requires supply Vdd be more positive than Vss). The base of transistor Q1 is connected to the emitter of transistor Q2, and the base of transistor Q2 is connected to supply Vss. The base of transistor Q4 is connected to the emitter of transistor Q3, and the base of transistor Q3 is connected to the junction between resistors R1 and R2. The opposite side of resistor R1 is connected to supply Vss, and the opposite side of resistor R2 is connected to the drain of MOSFET M3. Differential operational amplifier 14 has a positive input connected to the drain of MOSFET M6 and a negative input connected to the drain of MOSFET M1. The output of amplifier 14 is connected to the gates of MOSFETs M1–M6. PNP transistor Q5 has its emitter connected to the drain of MOSFET M4 and its collector connected to supply Vss. The base of transistor Q5 is connected to the drain of MOSFET M3. The output, which represents a regulated voltage output Vout, is connected across the collector and emitter of transistor Q5.

MOSFETs M1–M6 serve as current sources for respective legs of the circuit. More particularly, MOSFETs M1, M2, M4, M5 and M6 serve as current sources for respective transistors Q1, Q2, Q5, Q3 and Q4. MOSFET M3 serves as a current source for the voltage divider of resistors R1 and R2. Typically, each MOSFET M1–M4 has a width-to-length ratio significantly larger than the width-to-length ratio of each MOSFET M5 and M6. For example, the width-to-length ratio of each MOSFET M1–M4 may be 13 times that of each MOSFET M5 and M6. As a result, the current supplied to transistors Q1, Q2 and Q5, and to resistors R1 and R2 is 13 times the current to transistors Q3 and Q4. Also, typically, the active area of the emitters of each transistor Q3–Q5 is significantly larger than those of transistors Q1 and Q2. In one form, the active emitter area of transistors Q3–Q5 is 25 times that of transistors Q1 and Q2.

In operation of the circuit illustrated in FIG. 1, operational amplifier 14 will pull down the voltage Vg at the gates of MOSFETs M1–M6 until the inputs to the amplifier at the drains of MOSFETs M1 and M6 are equal, thereby balancing operational amplifier 14. With the inputs to operational amplifier 14 balanced, a voltage of NΔVbe appears across resistor R1, where N is the number of stacks in the array. The value of ΔVbe is a consequence of the ratioed emitter currents between transistors Q1 and Q2 on one hand and transistors Q3 and Q4 on the other hand (i.e. 13:1) as well as the ratioed emitter areas of the same transistors (25:1). Because the value of ΔVbe is coarsely dependent upon the dimensions of MOSFETs M1–M6 and the areas of the emitters of transistors Q1–Q4, the value of ΔVbe is ordinarily process insensitive; that is, the value of ΔVbe is not materially effected by small process variations during manufacture of the chip. The output voltage Vout equals the base-emitter diode drop across transistor Q5 plus the voltage across resistor R1 times the resistor ratio gain factor of 1+R2/R1.

$$Vout=N(1+R2/R1)\Delta Vbe+Vbe \quad (1)$$

Where N equals 2, as in the example of FIG. 1 having two stacks of ΔVbe voltage, the resistance values of resistors R1 and R2 are established so that the term 2(1+R2/R1)ΔVbe equals approximately 0.5 volts. Since the diode drop Vbe is about 0.72 volts, the reference voltage output, in theory, is about 1.22 volts.

In practice, however, offsets associated with the operational amplifier, resistances and current mirrors are also multiplied by the constant 1+R2/R1. As a result, errors due to offset are multiplied by the constant, adversely affecting the tolerance of the reference voltage.

Figure 2:
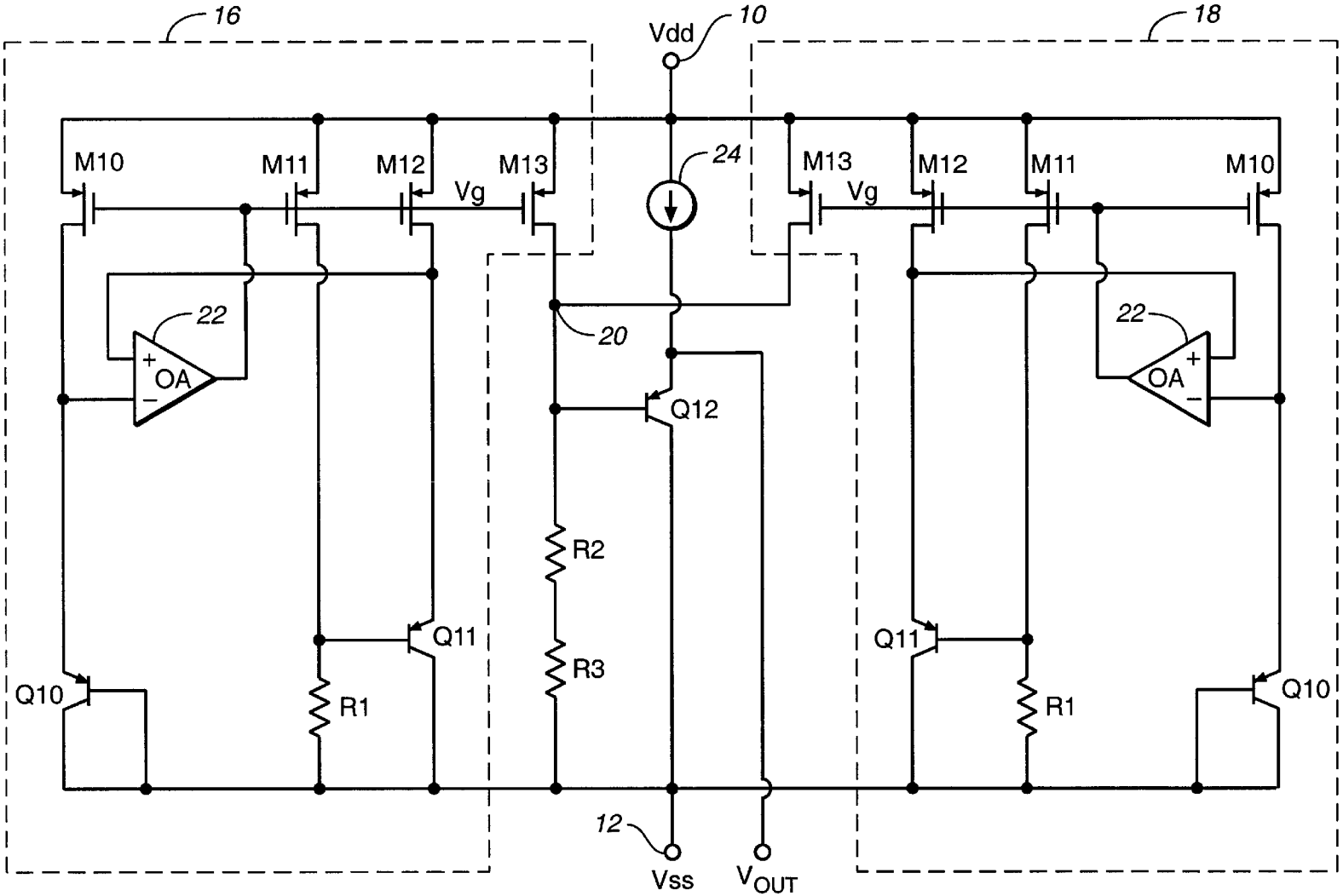
FIG. 2 is a circuit diagram of a current stacked array bandgap voltage reference source in accordance with the present invention.

The circuit illustrated in FIG. 1 can be improved by reducing the size of the constant 1+R2/R1 and increasing the number (stack) of transistors in the array. However, headroom limitations of the voltage supply limit the number of transistors and diode drops of the array. For example, transistors Q1 and Q2 and transistors Q3 and Q4 already represent the diode drops of approximately 1.4 volts. Increasing the number of transistors in the array increases the number of diode drops, thereby increasing the required voltage supplies Vdd and Vss. The present invention, illustrated in FIG. 2, is a current stacked voltage reference source that employs a single diode drop. This allows the number of stacks of the array to be increased without adding diode drops, permitting the gain constant to be reduced and a corresponding reduction of the effects of error sources. Consequently, lower reference voltage supplies may be realized.

FIG. 2 illustrates a pair of generation circuits 16 and 18 that each generate a current representative of ΔVbe. These currents are summed at node 20 for use in derivation of the output voltage Vout. Each generator circuit 16, 18 includes p-channel MOSFETs M10, M11, M12 and M13, having their sources connected through node 10 to supply Vdd and their gates connected together. The drain of MOSFET M10 is connected to the emitter of PNP transistor Q10 whose base and collector are connected through node 12 to supply Vss, the drain of MOSFET M11 is connected through resistor R1 to source Vss, the drain of MOSFET M12 is connected to the emitter of PNP transistor Q11 whose collector is connected to supply Vss and whose base is connected to the drain of MOSFET M11. The drain of MOSFET M13 is connected to node 20. Differential operational amplifier 22 has its inputs connected to the drains of MOSFETs M10 and M12 and its output connected to the gates of MOSFETs M10–M13.

Similar to the prior art example given above, the width-to-length ratio of each MOSFET M10, M11 and M13 is 13 times the width-to-length ratio of MOSFET M12. As a result, the current supplied by MOSFETs M10 and M11 to the emitter of transistor Q10 and to resistor R1 is 13 times the current applied to the emitter of transistor Q11. Similarly, the active emitter area of transistor Q11 is 25 times the active emitter area of transistor Q10. The value of ΔVbe is process insensitive, and is based on the ratioed emitter currents and emitter areas of transistors Q10 and Q11. The voltage representative of ΔVbe appears across resistor R1, so that when the inputs of operational amplifier 22 are equal, the output at the drain of MOSFET M13 is a current representative of ΔVbe.

The currents from generator circuits 16 and 18 are summed at node 20 and applied through the series resistors of resistors R2 and R3. While resistors R2 and R3 are depicted as separate resistors, they may, in fact, be a single resistor. For purposes of explanation, it will be assumed that resistor R3 has a value equal to resistor R1, so that the sum of the resistances of resistors R2 and R3 exceeds the resistance of each resistor R1. In the example illustrated in FIG. 2, the current representative of the voltage ΔVbe from each generator circuit 16, 18 is summed and applied to resistors R2 and R3. Therefore, the voltage across resistors R2 and R3 equals N(1+R2/R1)ΔVbe, where R1 equals R3 and N is the number of generator circuits 16, 18.

The current delivered by each MOSFET M13 to node 20 is representative of the current from MOSFET M12 to the emitter of transistor Q11. The current to the emitter of transistor Q11 is proportional to the voltage across resistor R1 divided by the value of resistor R1 (ΔVbe/R1) Therefore, the current applied to resistors R2 and R3 is directly proportional to N(ΔVbe/R1).

Current source 24 provides current to the emitter of PNP transistor Q12, whose base is connected to node 20 and whose collector is connected to supply Vss. The output Vout of the circuit is taken at the emitter of transistor Q12. Therefore, the reference output voltage from the circuit illustrated in FIG. 2 is the sum of the voltage across resistors R2 and R3 plus the base emitter diode drop of transistor Q12, $$Vout=N(1+R2/R1)\Delta Vbe+Vbe, \quad (2)$$

where R1 equals R3 and N is the number of generator circuits 16, 18.

The effects of errors due to offsets in the operational amplifier, resistors and mirrors, may be reduced by reducing the value of the constant (1+R2/R1), as in the prior art, such as by minimizing the value of resistor R2 or maximizing resistors R1 and R3. Also, like the prior art circuit of FIG. 1, the tolerance of the reference voltage source of FIG. 2 is improved with additional ΔVbe sources. Moreover, the circuit of FIG. 2 operates in the current mode, rather than the voltage mode. This permits the addition of ΔVbe sources without affecting the headroom of the supply voltage. Hence, the circuit of FIG. 2 requires no more than a single diode drop, so headroom for the voltage supply is increased. As a result, the present invention provides an on-chip reference voltage source delivering a high precision reference voltage while requiring low voltage supply.

While the present invention has been described in connection with discrete circuit elements, it is evident to one of ordinary skill in the art that the preferred embodiment is in the form of an integrated circuit or chip, and that the circuit is employed on a chip with other circuits. While the circuit of FIG. 2 has been described with positive and negative voltage supplies Vdd and Vss, the only requirement is that Vdd be more positive than Vss by the established minimal headroom. Moreover, while the invention has been described using a p-channel technology, it is evident that n-channel technology may be employed with suitable reversal of supplies. Also, in most cases the serial arrangement of the diode drops and gain impedances may be reversed from the arrangement depicted in FIG. 2, and some current sources, such as MOSFET M11 and current source 24, might be omitted. In some cases, diodes may be substituted for the transistors depicted in FIG.2. Additionally, while the exemplary embodiment illustrated in FIG. 2 depicts two current generator circuits, each deriving a current based on ΔVbe, any number of generator circuits may be employed, limited only by available real estate the chip and other constraining factors. Advantageously, increasing the number of generator circuits improves the tolerance of the reference voltage source.

Although the present invention has been described with reference to preferred embodiments, workers skilled in the art will recognize that changes may be made in form and detail without departing from the spirit and scope of the invention.

What is claimed is:

1. A method of generating a reference voltage comprising steps of:

(a) generating a plurality of currents each representing a first design voltage;

(b) summing the plurality of currents;

(c) deriving a gain voltage based on the sum of the plurality of currents; and (d) summing the gain voltage with a second design voltage.

2. The method of claim 1, wherein N number of currents are generated and each generated current represents 1/N times the gain voltage.

3. A current stacked reference voltage source for supplying a predetermined reference voltage comprising:

a plurality of current generators each generating a current representing a first design voltage, each current generator having no more than a single diode drop to generate the current;

a gain circuit responsive to the currents generated by the current generators to supply a gain voltage representing the sum of the first design voltages; and a summing circuit for summing the gain voltage and a second design voltage to derive the predetermined reference voltage.

4. The reference voltage source of claim 3, wherein there are N current generators each generating a current representing 1/N times the voltage supplied by the gain circuit.

5. The reference voltage source of claim 4, wherein the gain circuit has a gain constant, the gain voltage being equal to the sum of the first design voltages multiplied by the gain constant.

6. The reference voltage source of claim 5, wherein the summing circuit includes a semiconductor device having a control node and first and second controlled nodes and the second design voltage is a voltage established by a diode drop between the control node and the first controlled node, the gain circuit operating the semiconductor device to sum the first design voltage and the diode drop voltage.

7. The reference voltage source of claim 4, wherein the summing circuit includes a semiconductor device having a control node and first and second controlled nodes and the second design voltage is a voltage established by a diode drop between the control node and the first controlled node, the gain circuit operating the semiconductor device to sum the first design voltage and the diode drop voltage.

8. The reference voltage source of claim 3, wherein the gain circuit has a gain constant, the gain voltage being equal to the sum of the first design voltages multiplied by the gain constant.

9. The reference voltage source of claim 3, wherein the summing circuit includes a semiconductor device having a control node and first and second controlled nodes and the second design voltage is a voltage established by a diode drop between the control node and the first controlled node, the gain circuit operating the semiconductor device to sum the first design voltage and the diode drop voltage.

10. The reference voltage source of claim 3, including first and second nodes arranged to be connected to a voltage supply, the current generator and summing circuit being connected to the first and second nodes.

11. An integrated circuit chip having a plurality of circuits and a reference voltage circuit for supplying a reference voltage to the plurality of circuits, the reference voltage circuit comprising:

a plurality of current generators each having first and second current sources each having a control node, the control nodes of the first and second current sources being coupled together, a differential amplifier having a first input coupled to the first current source, a second input coupled to the second current source and an output coupled to the control nodes of the first and second current sources, a first semiconductor device having a control node and a controlled node, a first impedance coupled to the control node of the first semiconductor device in series with the second current source, and a third current source for supplying current representative of current supplied by the second current source;

a summing node for summing current supplied by each of the third current sources; and an output circuit having a second semiconductor device having a control node coupled to the summing node and having a controlled node, a second impedance coupled to a node of the second semiconductor device in series with the control and controlled nodes of the second semiconductor device, and an output coupled to a node of the second semiconductor device for providing the reference voltage.

12. The reference voltage circuit of claim 11, further including first and second supply nodes for connection to different voltage potentials of a voltage supply, the first supply node being coupled to the first, second and third current sources.

13. The reference voltage circuit of claim 11, wherein the third current source includes a control node coupled to the control nodes of the first and second current sources.

14. The reference voltage circuit of claim 11, wherein each of the first impedances provides a first impedance value (R1) and the second impedance provides a second impedance value greater than the first impedance value (R1+R2), the second semiconductor device operating with the second impedance circuit to provide a gain constant to a voltage at the control node of the second semiconductor device of (1+R2/R1).

15. The reference voltage circuit of claim 11, wherein each current generator further includes a third semiconductor device coupled to the first current source, the first and second current sources supplying different current values and the first and third semiconductor devices having different active areas, the first impedance providing a voltage ($\Delta$Vbe) to the control node of the first semiconductor device based on a difference between the current values supplied by the first and second current sources and the active areas of the first and third semiconductor devices.

16. The reference voltage circuit of claim 15, further including first and second supply nodes for connection to different voltage potentials of a voltage supply, the first supply node being coupled to the first, second and third current sources.

17. The reference voltage circuit of claim 15, wherein each of the first impedances provides a first impedance value (R1) and the second impedance provides a second impedance value greater than the first impedance value (R1+R2), the second semiconductor device operating with the second impedance to provide a gain constant to a voltage at the control node of the second semiconductor device of (1+R2/R1).

18. The reference voltage circuit of claim 17, wherein the second impedance provides a voltage to the control node of the second semiconductor device having a value of N(1+R2/R1)$\Delta$Vbe, where N is the number of current generators.

19. The reference voltage circuit of claim 18, wherein the second semiconductor device has a diode drop voltage (Vbe) between its control node and the controlled node, the output supplying the reference voltage having a value of N(1+R2/R1)$\Delta$Vbe+Vbe.

* * * * *